US007458132B2

(12) United States Patent
Kwon

(10) Patent No.: US 7,458,132 B2
(45) Date of Patent: Dec. 2, 2008

(54) OPEN-CLOSE EQUIPMENT FOR DOOR OF REFRIGERATOR

(75) Inventor: Yong-chol Kwon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 184 days.

(21) Appl. No.: 11/204,174

(22) Filed: Aug. 16, 2005

(65) Prior Publication Data

US 2006/0043852 A1 Mar. 2, 2006

(30) Foreign Application Priority Data

Aug. 31, 2004 (KR) ..... 10-2004-0068819

(51) Int. Cl.
*E05D 15/50* (2006.01)

(52) U.S. Cl. ..... 16/230; 16/231

(58) Field of Classification Search ..... 16/230–233, 16/258–262, 263; 312/405; 292/341.15, 292/163, 207, DIG. 72; 49/193, 382
See application file for complete search history.

(56) References Cited

U.S. PATENT DOCUMENTS 2,160,330 A * 5/1939 Hass et al. ..... 16/230
2,790,992 A * 5/1957 Campbell ..... 16/232
3,403,473 A * 10/1968 Navarro ..... 49/193
3,889,419 A * 6/1975 Maleck ..... 49/193
4,503,583 A * 3/1985 Frohbieter ..... 16/232
5,187,836 A * 2/1993 Kim et al. ..... 16/231
5,675,934 A * 10/1997 Park ..... 49/193
5,983,453 A * 11/1999 Miwa ..... 16/231

FOREIGN PATENT DOCUMENTS

JP 2000073639 A * 3/2000
JP 2003114087 A * 4/2003
JP 2003287363 A * 10/2003

* cited by examiner

*Primary Examiner*—Chuck Y. Mah
(74) *Attorney, Agent, or Firm*—Birch, Stewart, Kolasch & Birch, LLP

(57) ABSTRACT

The present invention relates to open-close equipment for a door of a refrigerator wherein a pair of doors are provided and opened or closed individually or integrally at a time. The open-close equipment of the present invention comprises right and left doors 60 and 70 for opening and closing each storage space 52 defined in a main body 50 of the refrigerator; a fixed hinge 62 provided at a right end of the right door 60 and serving as a pivot center of the right door 60; and a movable hinge 72 provided at a left end of the right door 70 and serving as a selective pivot center of the right door 70. Further, the right and left doors 60 and 70 are either pivoted individually on the fixed and movable hinges 62 and 72, respectively, or pivoted integrally and simultaneously on the fixed hinge 62 such that the doors are opened and closed. According to the present invention so configured, there are advantages in that convenience of use of the refrigerator is improved and electric power consumption is reduced.

19 Claims, 6 Drawing Sheets

OPEN-CLOSE EQUIPMENT FOR DOOR OF REFRIGERATOR

BACKGROUND OF THE INVENTION

1. Field of Invention

The present invention relates to a refrigerator, and more particularly, to open-close equipment for a door of a refrigerator wherein at least two doors are provided and opened or closed individually or integrally at a time.

2. Description of the Prior Art

In general, a refrigerator is divided into a freezing chamber for storing ice-making containers and frozen food at a predetermined temperature and a refrigerating chamber for storing objects to be refrigerated. A refrigeration cycle apparatus is installed in the refrigerator to perform a refrigeration cycle such as compression, condensation, expansion and evaporation cycles, and the interior of the refrigerator is kept at a refrigerating or freezing state using the phenomenon that external heat is absorbed in an evaporator of the circulation cycle.

FIG. 1 shows a perspective view of a general refrigerator.

As shown in the figure, a refrigerating chamber (not shown) for storing food and a freezing chamber (not shown) are formed within a rectangular box shaped body 10. In such a case, the freezing chamber is generally provided at an upper side while the refrigerating chamber is generally provided at a lower side.

Further, front faces of the refrigerating and freezing chambers are open and selectively opened and closed by freezing and refrigerating doors 12 and 14 as shown in the figure. Furthermore, freezing and refrigerating door handles 12' and 14' are formed on front surfaces of the freezing and refrigerating chambers 12 and 14, respectively, such that the doors can be easily opened and closed.

Therefore, if a user pulls forward the freezing and refrigerating door handles 12' and 14' respectively attached to the front surfaces of the freezing and refrigerating doors 12 and 14, the doors are pivoted on the right ends thereof to be opened forward.

However, the aforementioned related art refrigerator is configured in such a manner that only one door is provided at each storage chamber (a freezing or refrigerating chamber) and is pivoted on an end thereof to be opened forward.

That is, since only one refrigerating door 14 is provided in the refrigerating chamber, the door should be opened as a whole even when a user intends to store or take out a small amount of stored articles into or from the refrigerating chamber. Accordingly, there is a problem in that cold air is escaped unnecessarily from the refrigerating chamber.

SUMMARY OF THE INVENTION

Accordingly, the present invention is conceived to solve the aforementioned problem in the prior art. An object of the present invention is to provide a refrigerator having tow or more doors for opening and closing a freezing or refrigerating chamber.

Another object of the present invention is to provide open-close equipment for a door of a refrigerator, wherein two or more doors for each storage chamber can be opened and closed individually or integrally at one time.

According to an aspect of the present invention for achieving the objects, there is provided open-close equipment for a refrigerator door, comprising a pair of doors for opening and closing each storage space defined in a main body of a refrigerator; a fixed hinge provided between the main body of the refrigerator and one of the pair of doors and serving as a pivot center of the door; and a movable hinge provided between the main body of the refrigerator and the other of the pair of doors and serving as a selective pivot center of the door, wherein the pair of doors are either pivoted individually on the fixed and movable hinges, respectively, or pivoted integrally and simultaneously on the fixed hinge such that the doors are opened and closed.

The pair of doors may include a left door for selectively covering a left portion of the storage space, and a right door for selectively covering a right portion of the storage space.

The fixed hinge may include fixed hinge shafts fixedly installed respectively at upper and lower portions of the one door and serving as a pivot center of the door; and fixed hinge pieces fixedly installed to the main body to rotatably support opposite ends of the fixed hinge shafts.

The movable hinge may include movable hinge shafts which is movably installed respectively at upper and lower portions of the other door and serving as a selective pivot center of the door; and movable hinge pieces fixedly installed to the main body of the refrigerator and formed with hinge holes into which opposite ends of the movable hinge shafts are rotatably inserted and supported, and the movable hinge shafts may be selectively accommodated in the hinge holes of the movable hinge pieces, respectively.

Preferably, a connection piece for connecting the fixed and movable hinge shafts is installed to at least one of upper and lower sides of the pair of doors to allow the pair of doors to be simultaneously opened and closed.

The door may be provided with a hinge control device for controlling vertical movement of the movable hinge shaft to allow the movable hinge shaft to be selectively inserted into the hinge hole of the movable hinge piece.

The hinge control device may include an actuating lever provided at a door handle used to facilitate the opening and closing of the door; a transfer member installed between the actuating lever and the movable hinge shaft to allow the movable hinge shaft to be vertically moved according to movement of the actuating lever; and a return member installed at one side of the movable hinge shaft to apply a one-directional force to the movable hinge shaft.

According to the present invention, there are advantages in that convenience of use of the refrigerator is improved and electric power consumption is reduced.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of open-close equipment for a refrigerator door according to the present invention will be described in detail with reference to the accompanying drawings.

Figure 1:
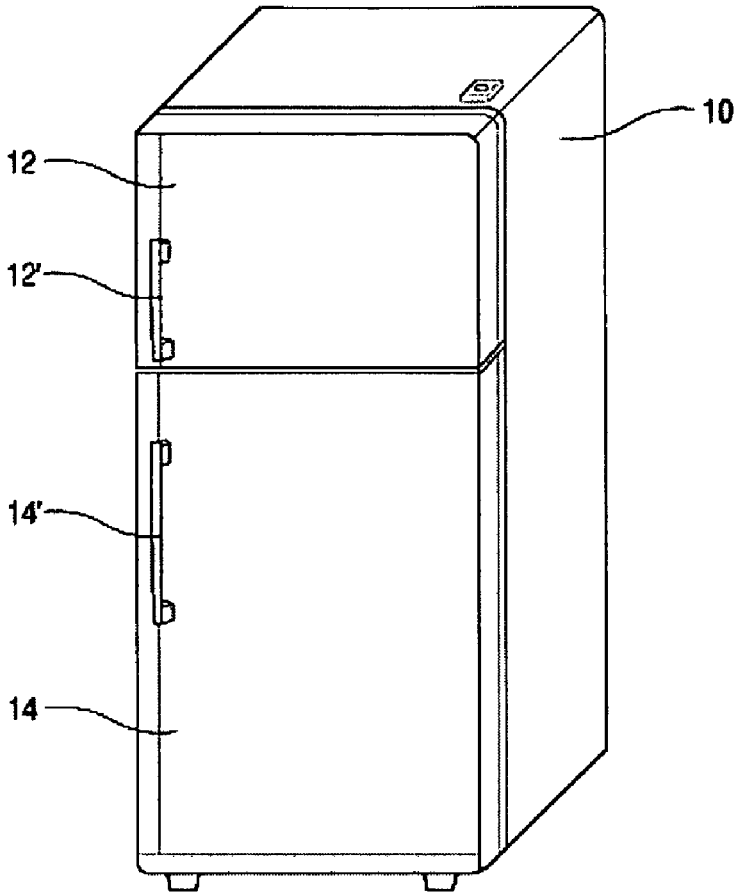
FIG. 1 is a perspective view showing an external appearance of a general refrigerator.
Figure 2:
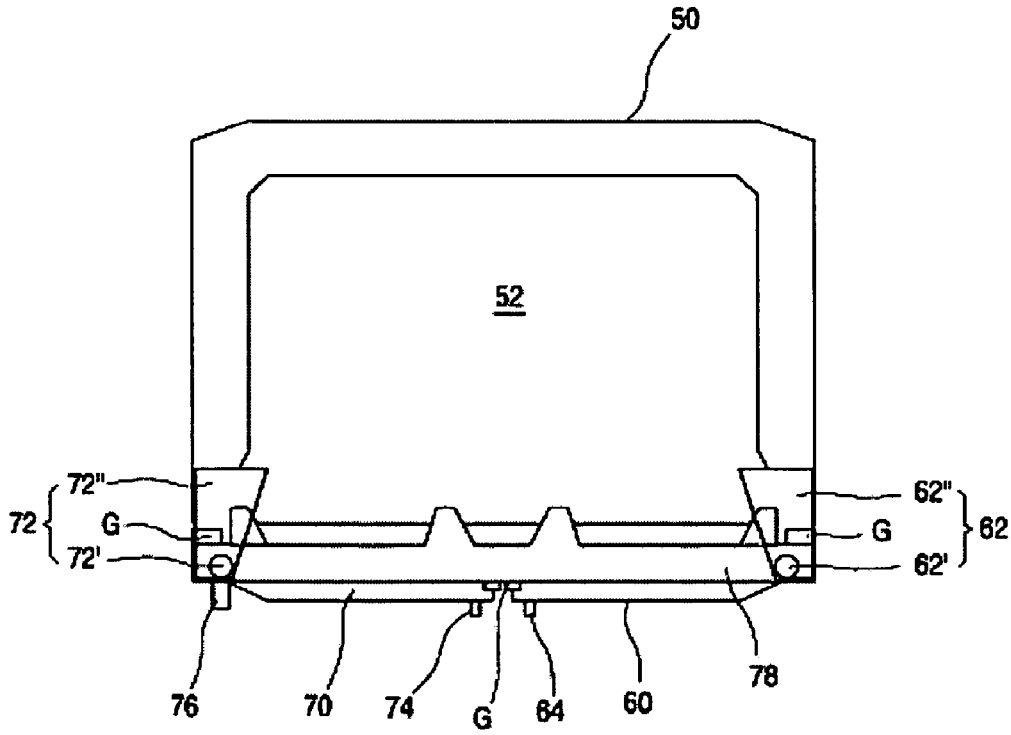
FIG. 2 is a plan view of a refrigerator to which open-close equipment for a refrigerator door is employed according to the present invention.
Figure 3:
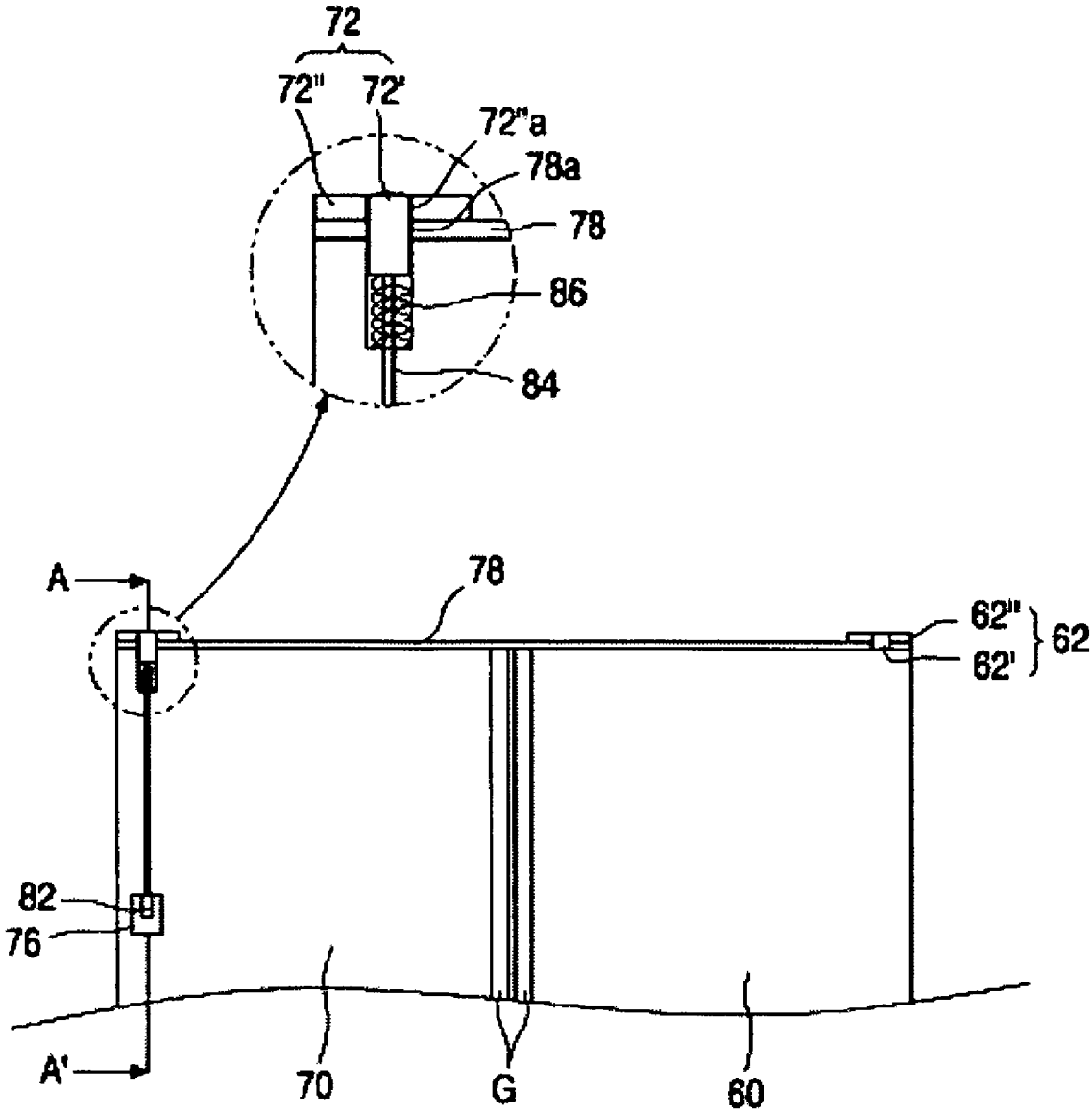
FIG. 3 is a partial front sectional view of the refrigerator to which the open-close equipment for the refrigerator door is employed according to the present invention.

FIGS. 2 and 3 are plan and front sectional views of a refrigerator, respectively, to which a preferred embodiment of open-close equipment for a refrigerator door according to the present invention is employed.

As shown in the figures, a storage space 52 is formed within a rectangular box shaped main body 50 of which a front face is open. The storage space 52 receives food and stores the stored food in a freezing or refrigerating state.

The front face of the storage space 52 is open and provided with a pair of doors 60 and 70. That is, the right door 60 for selectively covering a relatively right portion of the storage space 52 and the left door 70 for selectively covering a relatively left portion of the storage space 52 are pivotally installed to the front face of the main body 50.

A fixed hinge 62 that functions as a pivot center of the right door 60 is provided at each of upper and lower portions of the right end of the right door 60. The fixed hinge 62 is composed of a fixed hinge shaft 62' fixedly installed to extend upward or downward from the lower or upper end of the right door 60 and a fixed hinge piece 62" rotatably supporting an upper or lower end of the fixed hinge shaft 62'.

The fixed hinge shaft 62' is constructed of a cylindrical pin and serves as a pivot center when the right door 60 is pivoted forward. Further, the fixed hinge piece 62" is fixedly installed to the main body 50 to support the end of the fixed hinge shaft 62'.

Furthermore, gaskets G are also provided at a left end of the right door 60 and between the right door 60 and a right end on a front surface of the main body 50, respectively. The gasket G prevents cold air in the storage space 52 from leaking to the outside through a gap and also serves to absorb shock generated between the respective parts of the refrigerator.

In addition, a forward protruding right handle 64 is formed on a left end on a front surface of the right door 60. The right handle 64 has such a predetermined size that a user can easily grip the handle to conveniently open and close the right door 60.

A movable hinge 72 is provided at each of upper and lower portions of the left end of the left door 60. The movable hinge 72 selectively functions as a pivot center of the left door 70 and is composed of a movable hinge shaft 72' installed to a lower or upper end of the left door 70 to selectively serve as a pivot center of the left door 70, a movable hinge piece 72" rotatably supporting an end of the movable hinge shaft 72', and the like.

Figure 4:
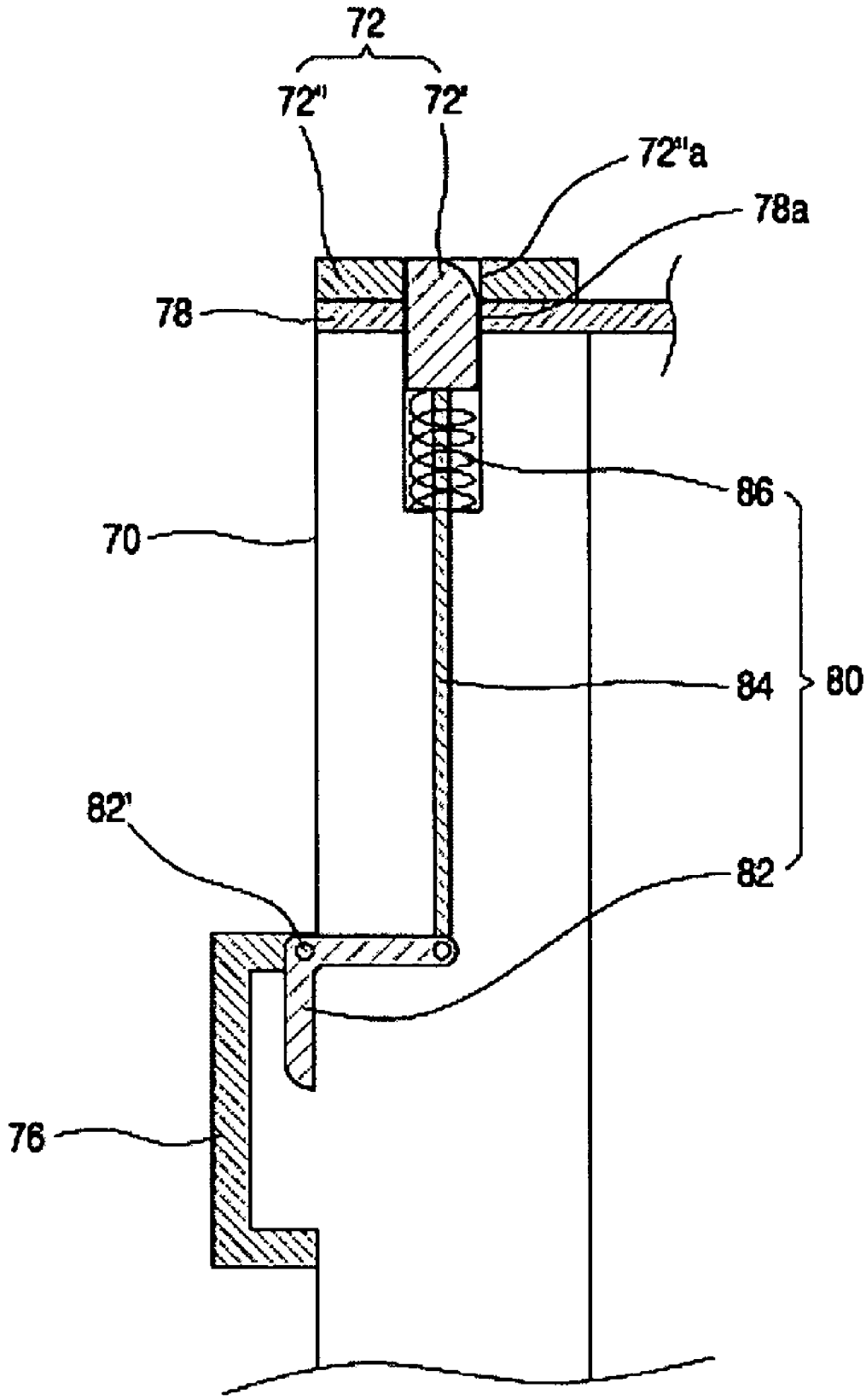
FIG. 4 is a sectional view taken along line A-A' of FIG. 3.
Figure 5:
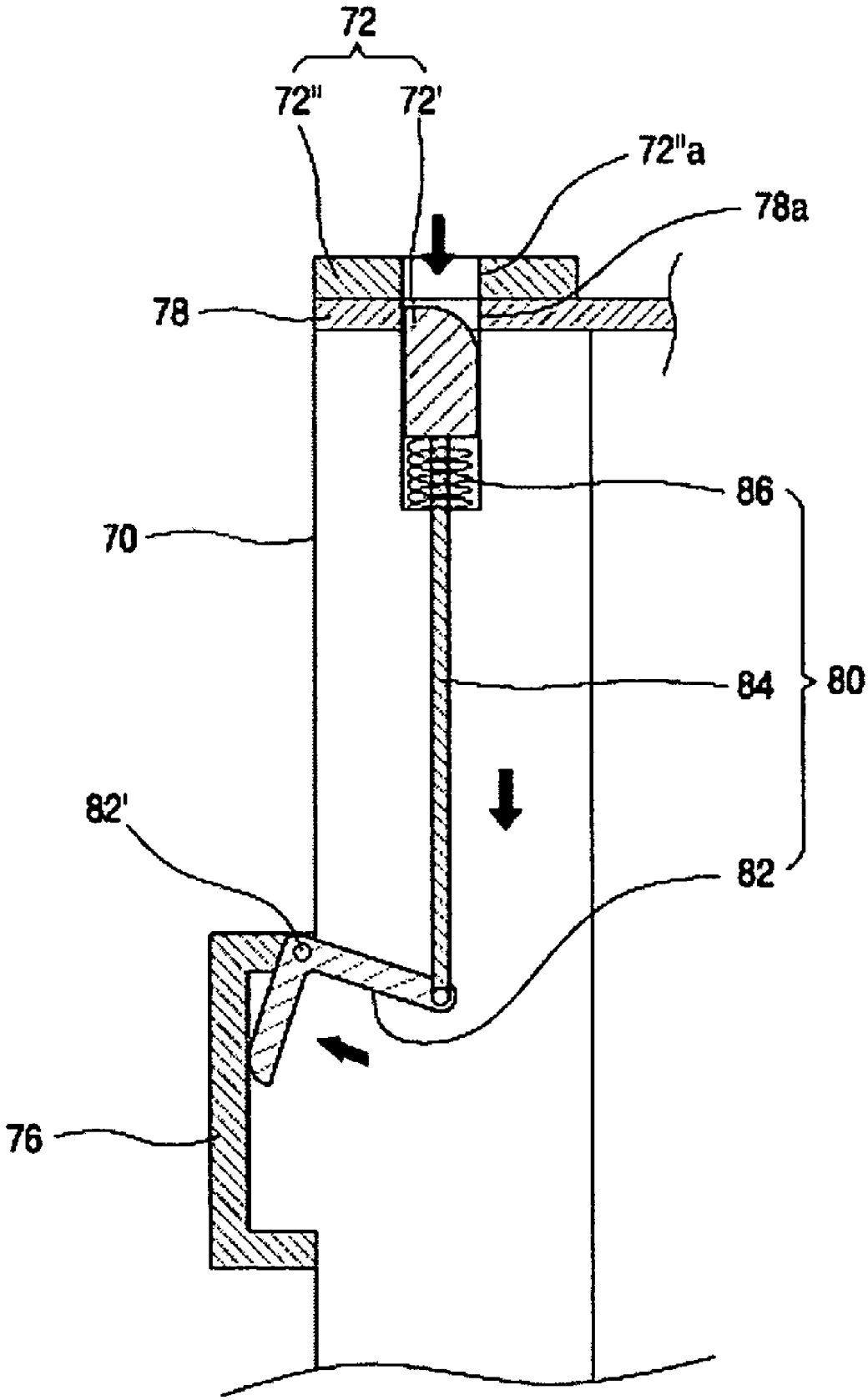
FIG. 5 is another sectional view taken along line A-A' of FIG. 3.

The movable hinge shaft 72' is constructed of a cylindrical column with a predetermined diameter and has a rounded upper rear end (refer to FIGS. 4 and 5). The reason that the upper rear end of the movable hinge shaft 72' is rounded in this way is that the movable hinge shaft 72' can be automatically fixed when the left door 70 is pivoted on a pivot center of the fixed hinge 62 in a closing direction.

The movable hinge piece 72" is formed with a hinge hole 72"*a* into which the movable hinge shaft 72' is inserted. Further, the movable hinge shaft 72' is installed to be movable in a vertical direction. That is, the movable hinge shaft 72' is moved to a certain degree in the vertical direction by means of a hinge control device 80 to be explained later and then selectively received in the hinge hole 72"*a* of the movable hinge piece 72". Thus, only when the movable hinge shaft 72' is inserted in the hinge hole 72"*a* of the movable hinge piece 72", the movable hinge shaft 72' can serve as a pivot center of the left door 70.

In the meantime, gaskets G are also provided at a right end of the left door 70 and at a left end on a rear surface of the left door 70, respectively, to prevent cold air in the storage space 52 from leaking to the outside. A forward protruding left handle 74 is formed on a right end on a front surface of the left door 70, and a door handle 76 is also formed on a left end on the front surface of the left door 70.

The left handle 74 is a handle used when the left door 70 is forward pivoted on the movable hinge 72 in an opening direction, while the door handle 76 is a handle used when both the right and left doors 60 and 70 are integrally pivoted forward on the fixed hinge 62.

A connection piece 78 is provided at upper sides of the right and left doors 60 and 70 in a horizontal direction. The connection piece 78 is used to support the right and left doors 60 and 70 when the right and left doors 60 and 70 are integrally opened and closed at one time. Preferably, another connection piece is provided at lower sides of the right and left doors 60 and 70.

Further, the connection piece 78 is preferably shaped as a flat plate, and hinge through-holes 78*a* into which the fixed and movable hinge shafts 62' and 72' are inserted are also formed in the right and left ends thereof. Further, a transfer member 84 and a return member 86, which will be explained later in detail, are provided at a lower end of the movable hinge shaft 72'.

FIG. 4 is a sectional view taken along line A-A' of FIG. 3.

As shown in the figure, the hinge control device 80 for controlling the vertical movement of the movable hinge shaft 72' is provided in the left door 70. Thus, the movable hinge 72' can be selectively inserted into the hinge hole 72"*a* of the movable hinge piece 72" by means of the hinge control device 80.

The hinge control device 80 comprises an actuating lever 82 which is installed to the door handle 76 used to facilitate simultaneous opening and closing of the right and left doors 60 and 70, the transfer member 84 which extends vertically between the actuating lever 82 and the movable hinge shaft 72', the return member 86 which applies a force to the movable hinge shaft 72 in one direction (upward direction), and the like.

As shown in the figure, the actuating lever 82 is formed in the "Γ" shape, and a lever hinge 82' serving as a pivot center is formed at the center thereof. Thus, a lower end of the actuating lever 82 is positioned at the rear of the door handle 76 to move forward or rearward, while a rear end of the actuating lever 82 is moved vertically according to the movement of the lower end of the actuating lever to cause the transfer member 84 to move vertically.

The transfer member 84 extends vertically in such a manner that its lower end is connected to the actuating lever 82 and its upper end is connected to the movable hinge shaft 72'. Thus, if the transfer member 84 is moved vertically as the actuating lever 82 is pivoted, the movable hinge shaft 72' is simultaneously moved vertically such that an upper end of the movable hinge shaft 72' is selectively inserted into the hinge hole 72"*a* of the movable hinge piece 72".

The return member 86 is installed within the upper end of the left door 70 and serves to urge the movable hinge shaft 72' upward. The return member is preferably constructed of a compression spring. Therefore, after the right and left doors 60 and 70 have been opened in a state where the movable hinge shaft 72' is moved downward, the movable hinge shaft 72' is again moved upward and returned to its original position.

Although an embodiment in which the movable hinge 72 is formed at the upper portion of the left door 70 has been described as above, a movable hinge formed at the lower portion of the left door 70 also has the same configuration as the previous movable hinge 72. Further, the upper movable hinge 72 and the lower movable hinge are connected to each other by means of an additional connection member (not shown) such that they can be operated simultaneously when the actuating lever 82 is pivoted.

Hereinafter, the operation of the open-close equipment for a door of a refrigerator according to the present invention so configured will be described.

Figure 6:
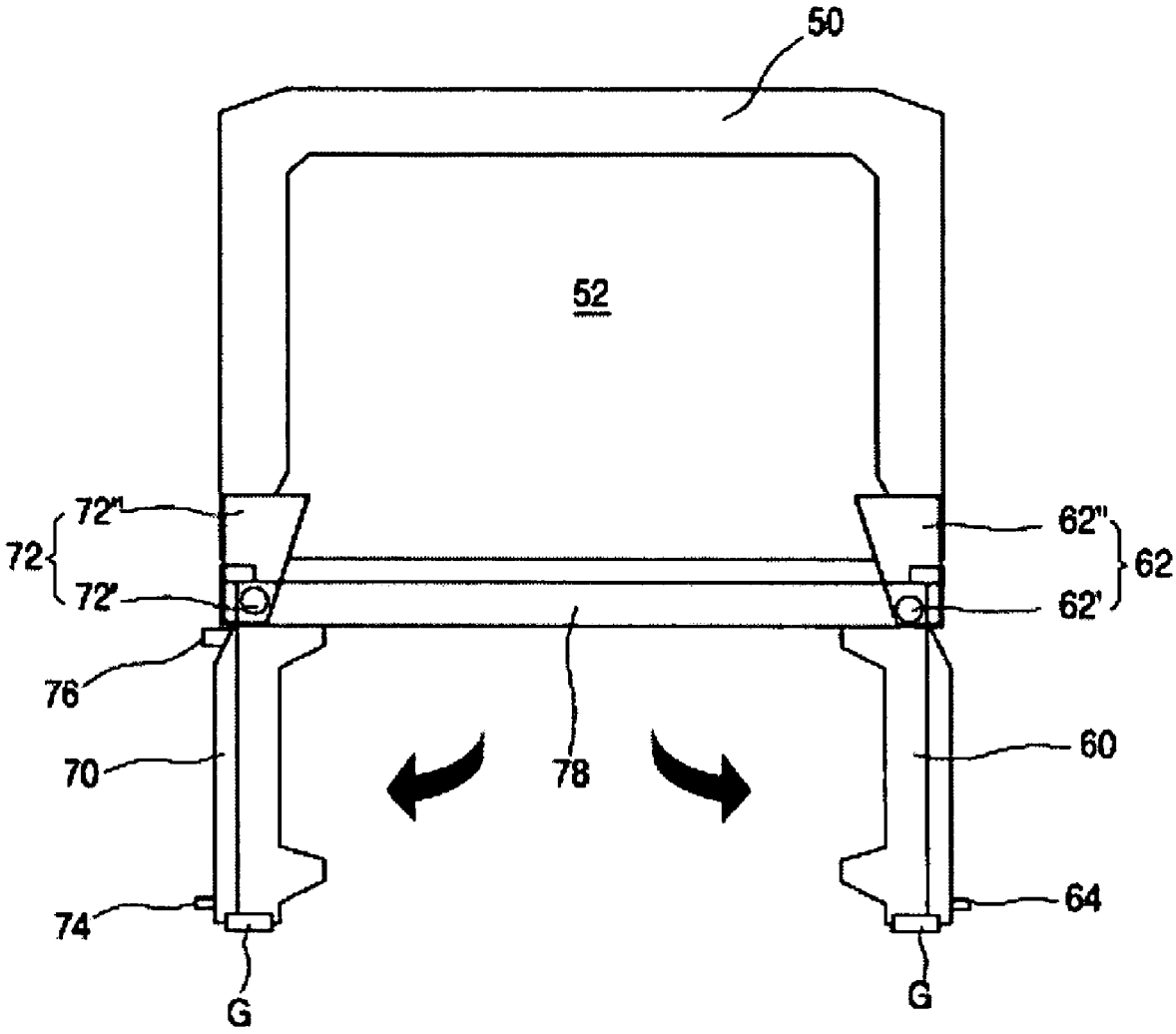
FIG. 6 is a plan view showing a state where a pair of doors constructing the refrigerator with the embodiment of the present invention employed thereto are individually opened.

First, FIG. 6 illustrates a general method of using the open-close equipment of the present invention. That is, in a case where the articles stored in the storage space 52 are relatively small, any one of the right and left doors 60 and 70 can be merely opened to accommodate or take out the food into or from the storage space. In such a case, the right or left door 60 and 70 can be pivoted on the fixed or movable hinge 62 or 72, as shown in FIG. 6.

At this time, the right and left handles 64 and 74 are used to open and close the right and left doors 60 and 70, respectively, and the movable hinge shaft 72' is inserted into the hinge hole 72"*a* of the movable hinge piece 72" to function as a pivot center of the left door 70, as shown in FIG. 4.

Next, an operating state where food with a relatively larger size is accommodated or taken out will be described with reference to FIG. 7.

If any one of the right and left doors 60 and 70 is opened, relatively larger food cannot be easily accommodated into the storage space. At this time, therefore, both the right and left doors 60 and 70 are simultaneously pivoted forward on the pivot center, i.e. the fixed hinge 62.

More specifically, the user grips the door handle 76 with a single hand. If the user grips the door handle 76 in this way, the lower end of the actuating lever 82 is simultaneously gripped. Thus, since the actuating lever 82 is pivoted on the lever hinge 82', the lower end of the actuating lever 82 is moved forward and the rear end of the actuating lever 82 is also moved downward.

Then, the transfer member 84 connected to the rear end of the actuating lever 82 is moved downward to thereby pull the movable hinge shaft 72' downward. At this time, the upper end of the movable hinge shaft 72' is drawn out from the hinge hole 72"*a* of the movable hinge piece 72". Therefore, if the user merely pulls the door handle 76 forward, both the right and left doors 60 and 70 can be opened as shown in FIG. 7.

That is, since the connection piece 78 is coupled to both the fixed and movable hinge shafts 62' and 72', both the right and left doors 60 and 70 can be simultaneously pivoted on the fixed hinge 62 serving as the pivot center in an opening direction. Then, a bulky article can be accommodated into or taken out from the storage space 52.

Figure 7:
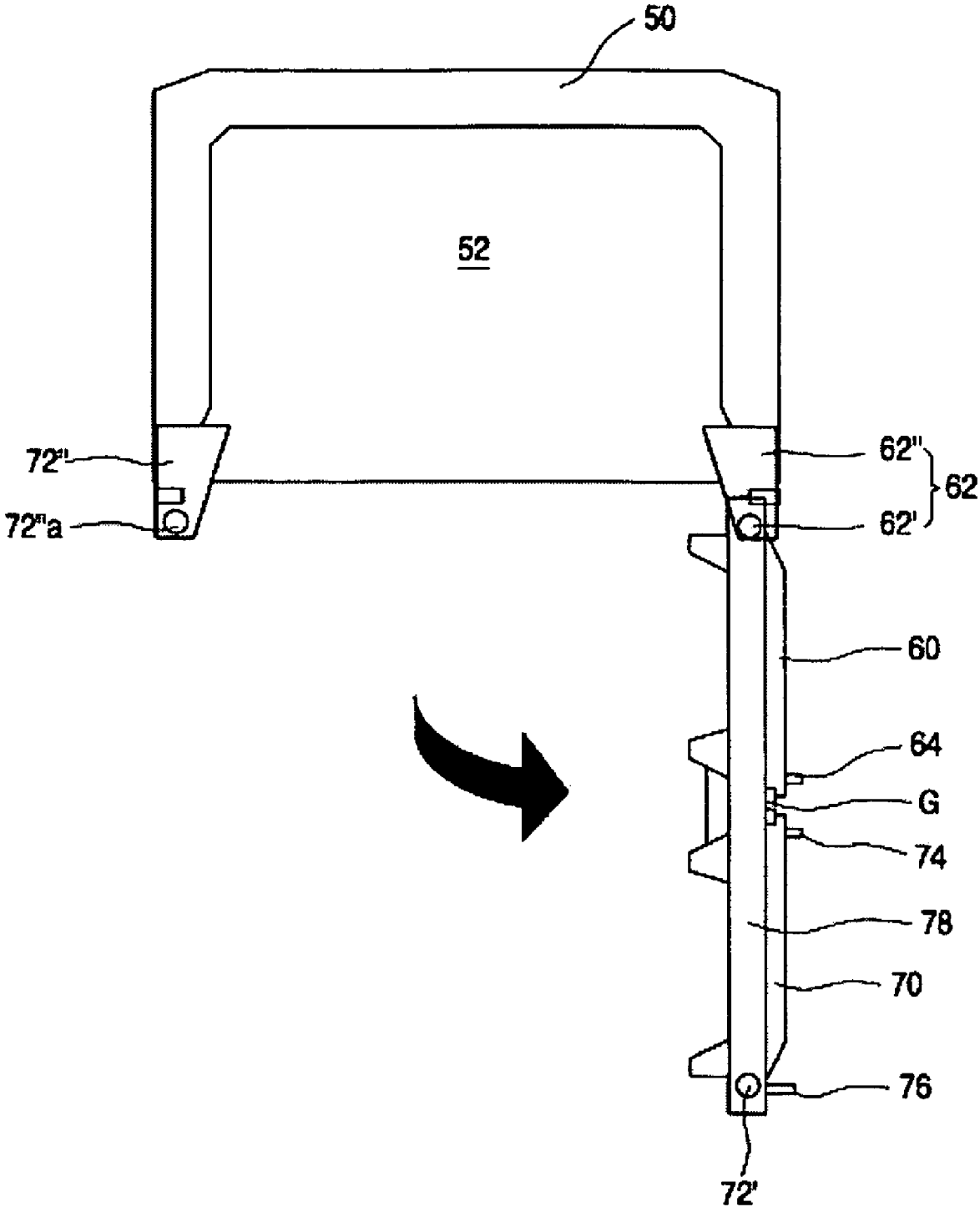
FIG. 7 is a plan view showing a state where the pair of doors constructing the refrigerator with the embodiment of the present invention employed thereto are integrally opened.

Further, in order to close the opened right and left doors 60 and 70 as shown in FIG. 7, the left door 70 is merely pushed rearward. Then, since the upper end of the movable hinge shaft 72' collides against the movable hinge piece 72" and is automatically moved downward, both the right and left doors 60 and 70 are simultaneously closed.

That is, the rear end of the movable hinge shaft 72' is bent round and the return member 86 is installed below the movable hinge shaft 72'. Therefore, when the movable hinge shaft 72' collides against a front end of the movable hinge piece 72", the movable hinge shaft 72' is moved downward. Then, when the left door 70 is brought into close contact with the front surface of the main body 50, the movable hinge shaft 72' is moved upward by means of the return member 86 and finally fixed in the hinge piece 72".

The scope of the present invention is not limited to the embodiments described and illustrated above but is defined by the appended claims. It will be apparent that those skilled in the art can make various modifications and changes thereto within the technical scope of the invention defined by the claims.

For example, although it has been described in the above embodiment that an additional hinge control device 80 is installed to the left door 70, it may be configured in such a manner that the left door can be pivoted using a friction force between the movable hinge shaft 72' and the main body 50 without the provision of the hinge control device 80. At this time, the movable hinge piece 72" for fixing the movable hinge shaft 72' of the left door 70 may not be provided. A fixing recess (not shown) with a predetermined depth enough for the upper end of the movable hinge shaft 72' to be seated therein is preferably formed on the main body 50.

Therefore, if the user pulls the door handle 76 forward with a certain force, the movable hinge shaft 72' is escaped from the fixing recess and both the right and left doors 60 and 70 can thus be simultaneously opened.

According to the open-close equipment for a refrigerator door of the present invention as described above in detail, each storage space is opened and closed by means of two doors. Therefore, since only a single door can be opened and closed when a relatively smaller article is accommodate into or taken out from the storage space, a relatively small amount of cold air can leak to the outside.

That is, since an opened area of the refrigerator door is reduced half as compared with when the front face of the storage space is fully opened due to the simultaneous opening of all the two refrigerator doors, the leakage of cold air is relatively reduced. Accordingly, there is an advantage in that electric power needed to operate the refrigerator can be reduced.

Further, since a connection piece for coupling the two doors with each other is provided, the two doors can be simultaneously opened, if necessary. Accordingly, since convenience in which the two doors should be individually opened when relatively larger food is received in the storage space is eliminated, there is another advantage in that convenience of use of the refrigerator can be improved.

What is claimed is:

1. Open-close equipment for a refrigerator, comprising:

first and second doors for respectively opening and closing first and second storage spaces defined in a main body of a refrigerator;

a fixed hinge provided between the main body of the refrigerator and the first door and serving as a pivot center of the first door such tat the first door can be individually opened in a counter clockwise direction by pivoting around the pivot center of the fixed hinge;

a movable hinge provided between the main body of the refrigerator and the second door and saving as a selective pivot center of the second door such that the second door can be individually opened in a clockwise direction by pivoting around the selective pivot center of the movable hinge; and a connection piece coupled to the fixed and movable hinge shafts and installed to the first and second doors so as to support the first and second doors while the first and second doors are simultaneously opened and closed, wherein the movable hinge includes a releasing mechanism configured to release the connection piece from the movable hinge such that the second door can be pivoted counter clockwise simultaneously with the first door around the pivot center of the fixed hinge, and wherein the second door includes a hinge control device to activate the releasing mechanism to release the second door from the movable hinge.

2. The open-close equipment as claimed in claim 1, wherein the second door covers a left portion of the storage space, and the first door covers a right portion of the storage space.

3. The open-dose equipment as claimed in claim 1, wherein the fixed hinge includes:

fixed hinge shafts fixedly installed respectively at upper and lower portions of the one door and serving as the pivot center of the first door; and fixed hinge pieces fixedly installed to the main body to rotatably support opposite ends of the fixed hinge shafts.

4. The open-close equipment as claimed in claim 3, wherein the releasing mechanism of the movable hinge includes:

movable hinge shafts movably installed respectively at upper and lower portions of the other door and serving as a selective pivot center of the door; and movable hinge pieces fixedly installed to the main body of the refrigerator and formed with hinge holes into which opposite ends of the movable hinge shafts are rotatably inserted and supported.

5. The open-close equipment as claimed in claim 4, wherein the connection piece is installed to at least one of upper and lower sides of the first and second doors to allow the pair of doors to be simultaneously opened and closed.

6. The open-close equipment as claimed in claim 4, wherein the hinge control device is configured to control a vertical movement of the movable hinge shaft to allow the movable hinge shaft to be selectively inserted into the hinge hole of the movable hinge piece.

7. The open-close equipment as claimed in claim 6, wherein the hinge control device includes:

an actuating lever provided at a door handle used to facilitate the opening and closing of the door;

a transfer member installed between the actuating lever and the movable hinge shaft to allow the movable hinge shaft to be vertically moved according to movement of the actuating lever; and a return member installed at one side of the movable hinge shaft to apply a one-directional force to the movable hinge shaft.

8. A refrigerator, comprising:

a main body having at least first and second storage spaces;

first and second doors for respectively opening and closing the first and second storage spaces;

a fixed hinge provided between the main body of the refrigerator and the first door and serving as a pivot center of the first door such that the first door can be individually opened in a counter clockwise direction by pivoting around the pivot center of the fixed hinge;

a movable hinge provided between the main body of the refrigerator and the second door and serving as a selective pivot center of the second door such that the second door can be individually opened in a clockwise direction by pivoting around the selective pivot center of the movable hinge; and a connection piece coupled to the fixed and movable hinge shafts and installed to the first and second doors so as to support the first and second doors while the first and second doors are simultaneously opened and closed, wherein the movable hinge includes a releasing mechanism configured to release the connection piece from the movable hinge such that the second door can be pivoted counter clockwise simultaneously with the first door around the pivot center of the fixed hinge, and wherein the second door includes a hinge control device to activate the releasing mechanism to release the second door from the movable hinge.

9. The refrigerator as claimed in claim 8, wherein the second door covers a left portion of the storage space, and the first door covers a right portion of the storage space.

10. The refrigerator as claimed in claim 9, wherein the fixed hinge includes:

fixed hinge shafts fixedly installed respectively at upper and lower portions of the one door and serving as the pivot center of the first door; and fixed hinge pieces fixedly installed to the main body to rotatably support opposite ends of the fixed hinge shafts.

11. The refrigerator as claimed in claim 10, wherein the releasing mechanism of the movable hinge includes:

movable hinge shafts movably installed respectively at upper and lower portions of the other door and saving as a selective pivot center of the door; and movable hinge pieces fixedly installed to the main body of the refrigerator and formed with hinge holes into which opposite ends of the movable hinge shafts are rotatably inserted and supported.

12. The refrigerator as claimed in claim 11, wherein the connection piece is installed to at least one of upper and lower sides of the first and second doors to allow the pair of doors to be simultaneously opened and closed.

13. The refrigerator as claimed in claim 12 wherein the hinge control device is configured to control a vertical movement of the movable hinge shaft to allow the movable hinge shaft to be selectively inserted into the hinge hole of the movable hinge piece.

14. The refrigerator as claimed in claim 13, wherein the hinge control device includes:

an actuating lever provided at a door handle used to facilitate the opening and closing of the door;

a transfer member installed between the actuating lever and the movable hinge shaft to allow the movable hinge shaft to be vertically moved according to movement of the actuating lever; and a return member installed at one side of the movable hinge shaft to apply a one-directional force to the movable hinge shaft.

15. Open-close equipment for a refrigerator door, comprising:

a pair of doors for opening and closing each storage space defined in a main body of a refrigerator;

a fixed hinge provided between the main body of the refrigerator and one of the pair of doors and serving as a pivot center of the door; and a movable hinge provided between the main body of the refrigerator and the other of the pair of doors and serving as a selective pivot center of the door; and a connection piece coupled to the fixed and movable hinge shafts and installed to the first and second doors so as to support the first and second doors while the first and second doors are simultaneously opened and closed, wherein the pair of doors are either pivoted individually on the fixed and movable hinges, respectively, or pivoted integrally and simultaneously on the fixed hinge such that the doors are opened and closed, wherein the fixed hinge includes:

fixed hinge shafts fixedly installed respectively at upper and lower portions of the one door and serving as a pivot center of the door; and fixed hinge pieces fixedly installed to the main body to rotatably support opposite ends of the fixed hinge shafts, wherein the movable hinge includes:

movable hinge shafts movably installed respectively at upper and lower portions of the other door and serving as a selective pivot center of the door; and movable binge pieces fixedly installed to the main body of the refrigerator and formed with hinge holes into which opposite ends of the movable hinge shafts are rotatably inserted and supported.

16. The open-close equipment as claimed in claim 15, wherein the pair of doors include a left door for selectively covering a left portion of the storage space, and a right door for selectively covering a right portion of the storage space.

17. The open-close equipment as claimed in claim 15, wherein the connection piece is installed to at least one of upper and lower sides of the pair of doors to allow the pair of doors to be simultaneously opened and closed.

18. The open-close equipment as claimed in claim 15, wherein the door is provided with a hinge control device for controlling vertical movement of the movable hinge shaft to allow the movable hinge shaft to be selectively inserted into the hinge hole of the movable hinge piece.

19. The open-close equipment as claimed in claim 18, wherein the hinge control device includes:

an actuating lever provided at a door handle used to facilitate the opening and closing of the door;

a transfer member installed between the actuating lever and the movable hinge shaft to allow the movable hinge shaft to be vertically moved according to movement of the actuating lever; and a return member installed at one side of the movable hinge shaft to apply a one-directional force to the movable hinge shaft.

* * * * *